United States Patent [19]

Toya

[11] 3,977,851

[45] Aug. 31, 1976

[54] AUTOMATIC ELECTRONIC ICE-MAKING CONTROL SYSTEM FOR AUTOMATIC ICE-MAKING MACHINE

[75] Inventor: Ko Toya, Toyoake, Japan

[73] Assignee: Hoshizaki Electric Co., Ltd., Toyoake, Japan

[22] Filed: May 12, 1975

[21] Appl. No.: 576,864

[30] Foreign Application Priority Data

May 17, 1974 Japan ..... 49-55082

[52] U.S. Cl. ..... 62/135; 62/209

[51] Int. Cl.[2] ..... F25C 1/00

[58] Field of Search ..... 62/135, 209, 340

[56] References Cited

UNITED STATES PATENTS 3,283,526 11/1966 Le Boeuf ..... 62/135

*Primary Examiner*—William E. Wayner

[57] ABSTRACT

An automatic electronic ice-making control system for automatic ice-making machines including an ice-making chamber in which is arranged a semiconductor temperature sensitive element which may comprise a thermistor, which translates temperature changes into resistance changes and for terminating an ice-making cycle a differential amplifier is provided in which said thermistor is connected as a temperature sensitive element, a variable resistance element sensitive to ambient changes being provided in said differential amplifier in series connection with said thermistor across a voltage source, the variable resistance element compensating the characteristics of the thermistor in accordance with atmospheric ambient temperature changes to actuate with an output signal derived from the differential amplifier a Schmidt circuit and relays in accordance with temperature conditions prevailing in the ice-making chamber and compensated for ambient temperature changes, thereby to terminate the ice-making operation upon production of substantially the same quantity of ice independent of the season of the year during which the ice-making machine is operative.

3 Claims, 1 Drawing Figure

AUTOMATIC ELECTRONIC ICE-MAKING CONTROL SYSTEM FOR AUTOMATIC ICE-MAKING MACHINE

BACKGROUND OF THE INVENTION

This invention relates to an automatic electronic ice-making control system for automatic ice-making machines.

Heretofore, in automatic ice-making machines of the type wherein an evaporator of the freezing system is arranged in the ice-making compartment for ice freezing, a number of detecting methods and equipments utilizing, for example, semiconductor temperature sensitive elements have been proposed for detecting the ice made state by measuring variations in temperature in the ice-making chamber with start of defrosting.

However, merely monitoring temperature variations is not sufficient to provide the desired results of this invention; i.e. making substantially the same quantity of ice by the ice-making machine independently of the season during which the ice-making machine is used. In such case, cooling time which is a function of ambient temperature conditions, cannot be ignored. For example, when the outdoor temperature goes down during the Winter, with increase of the cooling efficiency, the time it takes before a temperature sensitive element responds to the temperature actuating point at which a control circuit is to be operated, is relatively short so that the quantity of ice produced in the ice-making chamber during the ice-making cycle is decreased. On the other hand, when the outdoor temperature rises, as it does during the summer, with decrease of the cooling efficiency, the time it takes before the temperature sensitive element senses the temperature actuating point is longer so that the quantity of ice produced in the ice-making chamber is increased because of extended refrigeration which may cause cracks to be formed, lowering ice-making capacity.

It will be apparent therefore that the cooling efficiency of and the quantity of ice made by the ice-making machine is related to ambient temperature conditions; i.e. high efficiency in the Winter and thus less ice formation and lower efficiency in the summer and thus greater ice formation.

Ice-making machines have a freezing compartment, referred to herein as an ice-making chamber, such compartment and heat removing surface, on which a tray or trays for water to be frozen into ice cubes is supported, being illustrated, for example, in U.S. Pat. No. 3,283,526. The heat removing surface which in part forms the ice-making chamber is exposed to the atmosphere and is thus affected by atmospheric ambient temperature conditions. Since the heat removing surface or plate is provided with the temperature sensitive element the latter will therefore also be affected by ambient temperature changes to which the plate is exposed.

To ensure making a substantially uniform quantity of ice by the ice-making machine, independent of atmospheric ambient temperature changes, we provide in accordance with the invention in an ice forming system for ice-making machines having an ice-making chamber, an electronic control circuit for making uniform quantities of ice irrespective of atmospheric ambient temperature changes and comprising a voltage source, a differential amplifier supplied by the voltage source and having as its output a voltage tapped from the junction of series connected first and second temperature responsive elements, the free ends of which are connected to the voltage source, one only of the temperature responsive elements being within the ice-making chamber for detecting temperature changes therein, the other temperature responsive element being exposed to the atmosphere and being sensitive therefore to atmospheric temperature changes, both temperature responsive elements translating temperature changes into impedance changes, the impedance change of the second temperature responsive element with ambient temperature changes being effective to modify the temperature at which the first temperature responsive element is effective to provide a predetermined input voltage of sufficient magnitude to cause conduction of the differential amplifier, and by virtue of other components in the ice-forming system, when the differential amplifier becomes conductive, ice formation is terminated.

SUMMARY OF THE INVENTION

It is, therefore, a general object of the present invention to provide an automatic electronic ice-making control system for automatic ice-making machines wherein a differential amplifier includes a thermistor for detecting variation of temperature in the ice-making chamber and a variable resistance element for compensating the characteristics of the thermistor against variation of the outdoor temperature so that an end of the ice formation is determined.

A principal object of the present invention is to provide an automatic electronic ice-making control system for automatic ice-making machines in which an evaporator is arranged in the ice-making chamber for ice freezing, characterized by providing a temperature sensitive element in the ice-making chamber for detecting changes in temperature therein and a variable resistance element, both incorporated in a differential amplifying circuit which is so constructed that a resistance change caused by the variable resistance element so designed as to become operative when the series connection of the variable resistance element and thermistor across the voltage source provides the same predetermined input voltage, from the tap of the series connected variable resistance element and thermistor, to differential amplifier which because of the changing impedance of the variable resistance element, in accordance with ambient temperature conditions, and of the thermistor, is effectively operated only when the desired predetermined quantity of ice is produced independently of the season involved. In other words, because of the effect of ambient temperature on the ice plate and therefore on the thermistor and also because of the temperature compensation provided by the variable resistance element the net effect is to change the temperature actuating point of the thermistor so that in the summer the time it takes to reach the temperature actuating point is decreased and the time it takes to reach the temperature actuating point in the winter is increased. Thereby substantially the same quantity of ice is produced by the ice-making machine whether the machine is operated during the summer or the winter season.

Objects and advantages of the present invention will become readily apparent and understood from the following description and the accompanying drawings in which the same reference numerals designate the same or similar parts throughout the drawings.

DESCRIPTION OF THE PREFERRED EMBODIMENTS

Figure 1:
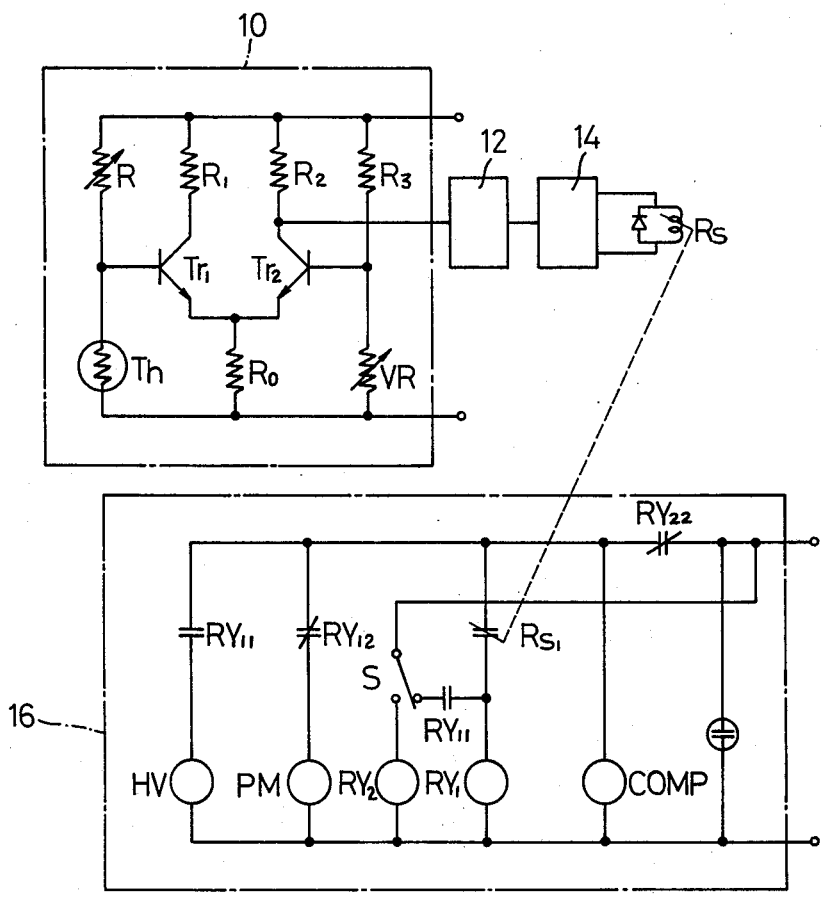
FIG. 1 is an electric circuit showing an embodiment of the present invention.

Referring to FIG. 1, the reference number 10 denotes a transistor differential amplifier including two transistors $Tr_1$ and $Tr_2$. To the base terminal of the transistor $Tr_1$ are connected a negative thermistor Th and a variable resistance element R having the same characteristics as thermistor Th. The thermistor Th is disposed in the ice-making chamber to detect changes in temperature in the ice-making chamber and the variable resistance element R compensates for the resistance changes in the thermistor Th resulting from atmospheric ambient temperature changes.

That is, the base terminal of the transistor $Tr_1$ is connected through the thermistor Th to the negative terminal and also connected through the variable resistance element R to the positive terminal. Emitter terminals of the transistor $Tr_1$ and $Tr_2$ are connected through a common resistance $R_0$ to the negative terminal, and each collector terminal is connected through resistances $R_1$, $R_2$ to the positive terminal, respectively. Furthermore, the base terminal of the transistor $Tr_2$ is connected to the negative terminal through the variable resistor VR and also connected to the positive terminal through the resistance $R_3$.

In the differential amplifier 10 thus constructed, providing that a preset impedance of the variable resistance element R at an outdoor temperature TH is $Z_{RH}$, that the impedance of thermistor Th at the desired ice-making detecting temperature $T_0$ is $Z_{TH}$, and that the voltage applied across the terminals of differential amplifier 10 is V, the base voltage (voltage at the end of ice formation) $V_{BEH}$ of the transistor $Tr_1$ which is capable of actuating the Schmidt circuit as hereinafter described may be given by the following formula:

$$V_{BEH} \approx \frac{Z_T}{Z_R + Z_T} \times V \qquad (1)$$

Therefore, the differential amplifier 10 is so designed that when the base voltage $V_{BEH}$ of the transistor $Tr_1$ is given by the foregoing formula, a predetermined output voltage may be derived on the collector terminal of the transistor $Tr_2$. Moreover, a miner regulation of the differential amplifier 10 may be performed by the variable resistor VR. The resistance of the thermistor Th is appropriately set in conformity with the characteristics of the ice-making machine.

In the example, a negative thermistor is used as a temperature sensitive element i.e. the impedance of the thermistor increases as the temperature goes down and the impedance $Z_{RH}$ of the variable resistance element R is also increased with increase of the denominator of the formula (1), that is, when the outside temperature goes down, for example, so that the base voltage of the transistor $Tr_1$ is not maintained at the voltage of $V_{BEH}$ and hence the transistor $Tr_2$ does not become conductive. To maintain the base voltage of the transistor $Tr_1$ at the voltage of $V_{BEH}$, the ice-making chamber is further refrigerated to make the impedance of the thermistor Th exceed $Z_{TH}$, it being understood that the impedance of the variable resistance is likewise incrementally increased as the outside temperature goes down, so that the base voltage of the transistor $Tr_1$ reaches the voltage $V_{BEH}$ both transistors $Tr_1$ and $Tr_2$ become conductive of the impedance of the variable resistance element, so that the base voltage of the transistor $T_1$ is maintained at the voltage $V_{BEH}$ and the transistor $Tr_2$ comes to the ON position.

Should the atmospheric ambient temperature now rise, the impedance of the thermistor Th will be lowered below the impedance $Z_{TH}$ and because of the compensating impedance change of the variable resistance R, the input voltage $V_{BEH}$ will be reached at a temperature sensed by the thermistor Th in the ice-making chamber which is relatively higher to cause operation of the differential amplifier at a somewhat higher temperature thereby producing substantially the same quantity of ice in the summer as occurs in the winter.

A Schmidt circuit 12 is connected to the collector terminal of the transistor $Tr_2$ incorporated in the differential amplifier 10 and a relay circuit 14 is likewise connected to the same collector terminal so that when a predetermined output voltage is derived in the differential amplifier 10, the Schmidt circuit 12 with the relay circuit 14 are actuated to control the ice-making control circuit 16 with development of a constant quantity of homogeneous ice independent of the atmospheric temperature.

In the ice-making control circuit, an actuation of the relay Rs in the relay circuit 14 closes a usually-opened contact $R_{s1}$ cooperative with a relay $R_s$ to actuate a relay $RY_1$ with close of usually-opened contacts $RY_{11}$, $RY_{11}$ serving to lock for the self-holding of the relay $RY_1$ and then a hot gas valve HV is opened while opening the usually-closed contact $RY_{12}$ cooperative with the relay $RY_1$ to cease the driving operation of the water circulating pump PM. Thus, the defrosting is carried out by supplying the hot gas into the evaporator of the ice-making chamber. After complete removal of ice cubes from the ice making chamber during defrost an appropriate detecting unit operates to terminate the defrosting part of the cycle to then initiate the ice-making operation.

Moreover, the circuit 16 may be provided with a holding circuit switch S for relay $RY_1$ which is so constructed that when the ice storage tank is filled with ice cubes the contact is switched to actuate a delay relay $RY_2$ while opening a normally closed contact $RY_{22}$ cooperative with said delay relay $RY_2$ thereby to interrupt all the control circuits for the compressor COMP of the refrigeration system, and for the water circulating pump PM and the hot gas valve HV to terminate the ice-making operation.

Thus, according to the present invention, it is possible to make a predetermined quantity of homogeneous ice cubes through all the seasons of the year by effectively adjusting the temperature point in the ice-making chamber at which the thermistor Th is effective to provide in conjunction with the series connected variable resistance element R the input voltage $R_{BEH}$ at which the differential amplifier will be rendered conductive to terminate the ice-making operation.

Moreover, the temperature sensitive element such as a thermistor adapted to be used in the system according to the present invention may, as far as it is an element having an ability of converting the temperature change into the resistance change, be selectively used irrespective of the magnitude of the resistance change and polarity of the characteristics in consideration of polarity of the differential amplifier and the connecting position of the gain element.

It will be appreciated that the system according to the present invention may, when the integrated circuit is used, be made as a compact apparatus.

While certain preferred embodiments of the invention have been illustrated by way of example in the drawings and particularly described, it will be understood that various modifications may be made in the apparatus and constructions and that the invention is no way limited to the embodiments shown.

What I claim is:

1. In an ice forming system for ice-making machines having an ice-making chamber, an electronic control circuit for making uniform quantities of ice irrespective of atmospheric ambient temperature changes and comprising a voltage source, a differential amplifier supplied by said voltage source and having as its input a voltage tapped from the junction of series connected first and second temperature responsive elements the free ends of which are connected to said voltage source, one only of said temperature responsive elements being within said ice-making chamber for detecting temperature changes therein, the other temperature responsive element being exposed to the atmosphere for sensing atmospheric ambient temperature changes, both temperature responsive elements translating temperature changes into impedance changes, the impedance change of the second temperature responsive element with ambient temperature changes being effective to modify the temperature at which the first temperature responsive element is effective to produce a predetermined input voltage of sufficient magnitude to cause conduction of said differential amplifier.

2. In an ice-making system according to claim 1, wherein the differential amplifier generates an output signal when said predetermined input voltage is supplied to said amplifier, a Schmidt circuit connected to said amplifier and energized by its output, and relays activated by an output of a Schmidt circuit and having contacts controlled by said relays for in turn controlling components of the ice-making machine for ending ice formation.

3. In an ice forming system according to claim 1, wherein said input voltage is $V_{BEH}$ which is determined by the impedance value of said first and second temperature responsive elements in accordance with the formula $$V_{BEH} = \frac{Z_T}{Z_R + Z_T} \times V$$

where $Z_T$ is the impedance of the first temperature responsive element, $Z_R$ is the impedance of the second temperature responsive element and V is the voltage of said voltage source.

* * * * *